US006227813B1

(12) United States Patent
Leimer

(10) Patent No.: US 6,227,813 B1
(45) Date of Patent: May 8, 2001

(54) APPARATUS FOR PUMPING MORTAR GROUT

(76) Inventor: Melvern D. Leimer, 9015 Calvine Rd., Sacramento, CA (US) 95829

( * ) Notice: Subject to any disclaimer, the term of this patent is extended or adjusted under 35 U.S.C. 154(b) by 0 days.

(21) Appl. No.: 09/354,623

(22) Filed: Jul. 16, 1999

Related U.S. Application Data

(63) Continuation-in-part of application No. 29/098,405, filed on Dec. 29, 1998.

(51) Int. Cl.[7] ..... F04B 53/00
(52) U.S. Cl. ..... 417/234; 366/15
(58) Field of Search ..... 415/72, 234; 417/344, 417/313; 366/15, 17, 46, 28; 425/64; 222/232, 626, 333

(56) References Cited

U.S. PATENT DOCUMENTS

| | | | | |
|---|---|---|---|---|
| 3,716,304 | * | 2/1973 | Coles | 415/72 |
| 4,036,564 | * | 7/1977 | Richards | 417/344 |
| 4,117,547 | * | 9/1978 | Mathis et al. | 366/17 |
| 4,147,331 | * | 4/1979 | Kopecky | 366/46 |
| 4,285,598 | | 8/1981 | Horton | 366/15 |
| 4,492,478 | * | 1/1985 | Ito et al. | 366/28 |
| 4,718,826 | * | 1/1988 | Simmer | 417/234 |
| 5,018,955 | * | 5/1991 | Parrish et al. | 425/64 |
| 5,054,658 | * | 10/1991 | Aronie | 222/232 |
| 5,122,038 | * | 6/1992 | Malkoski | 417/313 |
| 5,314,100 | * | 5/1994 | Deaver | 222/626 |
| 5,878,921 | * | 3/1999 | Chase et al. | 222/333 |

FOREIGN PATENT DOCUMENTS

| | | | | |
|---|---|---|---|---|
| 2420023 | * | 11/1975 | (DE) | B28C/7/06 |
| 4025590 | * | 2/1992 | (DE) | B28C/5/16 |
| 0624394 | * | 5/1994 | (DE) | B01F/5/12 |
| 8707858 | * | 6/1987 | (FR) | E04F/21/08 |
| 332230 | * | 7/1995 | (JP) | F04B/15/02 |
| WO 93/23223 | * | 5/1993 | (SE) | B28C/5/34 |

* cited by examiner

*Primary Examiner*—Teresa Walberg
*Assistant Examiner*—Leonid Fastovsky
(74) *Attorney, Agent, or Firm*—R. Michael West; Boutin, Dentino, Gibson, Di Giusto, Hodell, & West

(57) ABSTRACT

An apparatus for pumping mortar. A hopper for containment of mortar is mounted on a portable frame. A mortar pump has an inlet located within a lower portion of the hopper, and a discharge located outside the hopper. A rotary drive shaft has a lower end attached to the mortar pump, and a median portion passing through the contained mortar. The drive shaft is oriented at a vertical angle sufficient so that an upper end of the shaft extends above an upper level of the mortar. An engine, also mounted on the frame, rotates the upper end of the drive shaft, powering the mortar pump. One end of a mortar distribution hose is connected to the discharge of the pump. The other end of the hose extends to a remote location, and is fitted with a mortar application nozzle. Mortar is pre-mixed in a concrete mixer and poured into the hopper. The mortar pump forces mortar through the distribution hose and out the nozzle, where it is directed by a mason on to joints and into grout lines.

18 Claims, 4 Drawing Sheets

Fig. 3
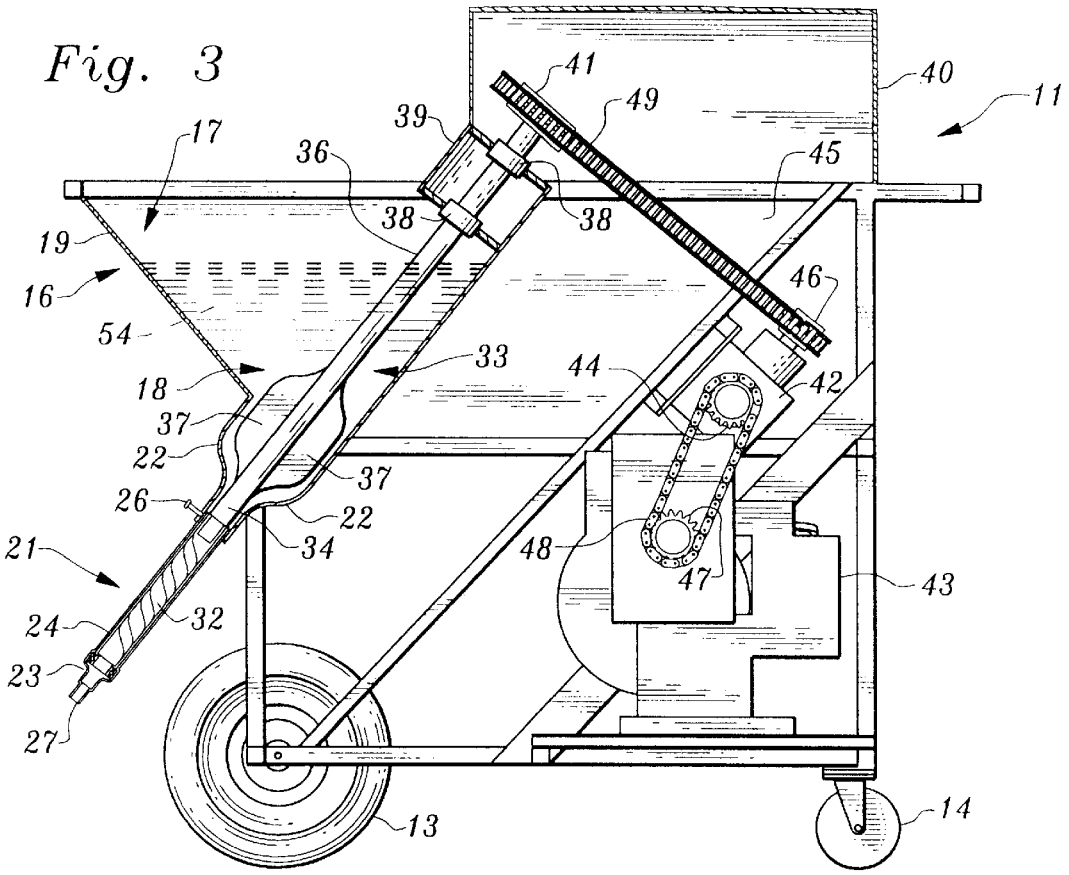
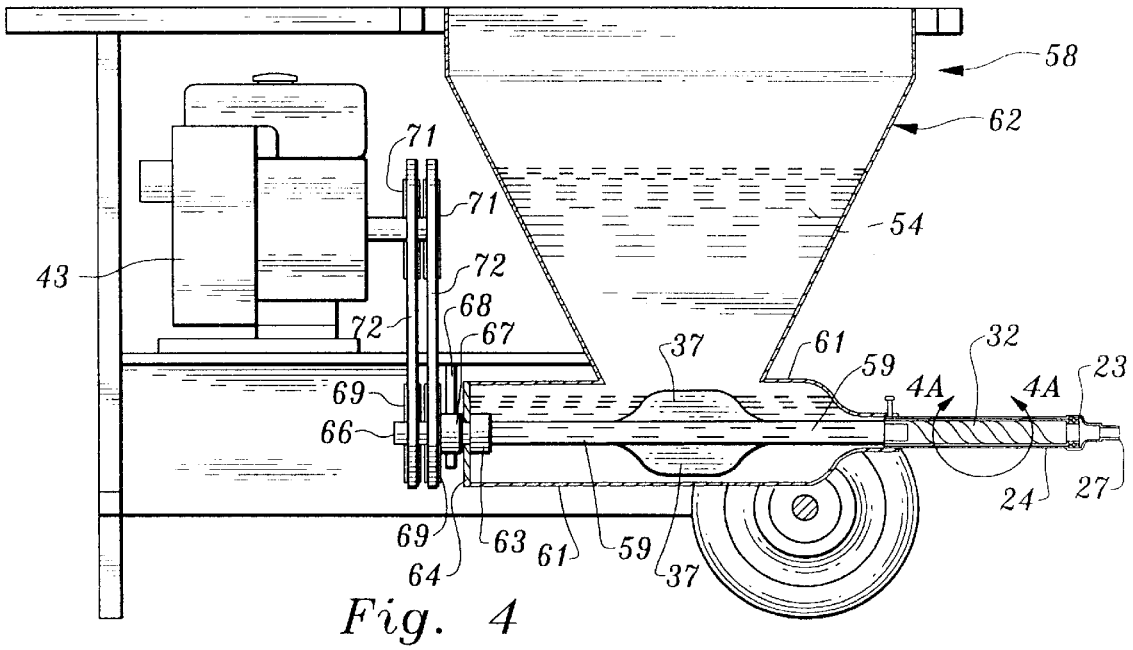
Fig. 4
(PRIOR ART)

APPARATUS FOR PUMPING MORTAR GROUT

CROSS REFERENCE TO RELATED APPLICATION

This application is a continuation-in-part of my co-pending application Ser. No. 29/098,405, filed Dec. 29, 1998.

BACKGROUND OF THE INVENTION

1. Field of the Invention

The invention relates generally to devices used in the masonry trade for pumping and transporting mortar grout from a mixing site to an application site. More specifically, the invention pertains to a portable pumping apparatus including a containment hopper and a motor-driven mortar pump mounted at a vertical angle therein. The raised, upper end of the mortar pump is maintained out of the mortar mix, thereby eliminating the necessity of a seal and providing longevity and efficiency in the operation of the pumping apparatus.

2. Description of the Prior Art

It is well known in the art to provide a portable mortar pumping apparatus for use at a construction site. Typically, such pumping devices include a mobile frame supporting a mortar containment hopper. A mortar pump is horizontally disposed within a lower portion of the hopper, and includes an inlet end for receiving mortar. A worker loads a batch of previously mixed mortar into the hopper. The pump's inlet is thereby immersed in wet mortar. A gasoline engine or an electric motor is also mounted on the frame. The worker controls the operation of the engine. The engine rotates a drive shaft connected to a pumping auger or helical screw element within the mortar pump. The auger pumps mortar through a discharge outlet, to which a distribution hose has been connected. The hose extends to a horizontally or vertically remote site, where a mason or a tile-setter applies a stream of pumped mortar to brick, block, tile, or other construction materials.

The above-described prior art device has a number of drawbacks. At the inlet end of the pump, where the drive shaft passes through an end wall in the pump's housing, a seal is provided. The seal is included to allow passage of the rotating drive shaft while preventing mortar from leaking out around the shaft. Unfortunately, mortar is a highly abrasive and corrosive material, inevitably causing a premature failure of the seal. Once the mortar begins to leak out around the shaft, the pumping operation must be stopped for repair of the pump. Removal of the pump and replacement of the seal is a time consuming job, and may result in loss of the mortar already mixed. The repair job also reduces the production efficiency of the mason and the worker, by taking them off the job.

It is an object, therefore, of the present invention to provide a mortar pump construction which can operate for extended periods of time without shutting down for repairs.

Another object of the invention is to provide a mortar pump construction in which mortar cannot leak out around the drive shaft.

Yet another object of the invention is to provide a structural relationship between the mortar hopper, a mortar pump, and a pump drive system which eliminates the need for a drive shaft seal.

Yet another object of the invention is to provide a means for maintaining one end of the drive shaft for the mortar pump above the contained mortar at all times.

The preceding objects, as well as others will become apparent, in the drawings and the written description of the invention to follow.

BRIEF DESCRIPTION OF THE DRAWINGS

FIG. 3 is a cross-sectional view, taken on the line 3—3 in FIG. 1;

FIG. 4 is a cross-sectional view of the prior art apparatus, taken on the line 4—4 in FIG. 2.

DETAILED DESCRIPTION OF THE PREFERRED EMBODIMENT

Figure 1:
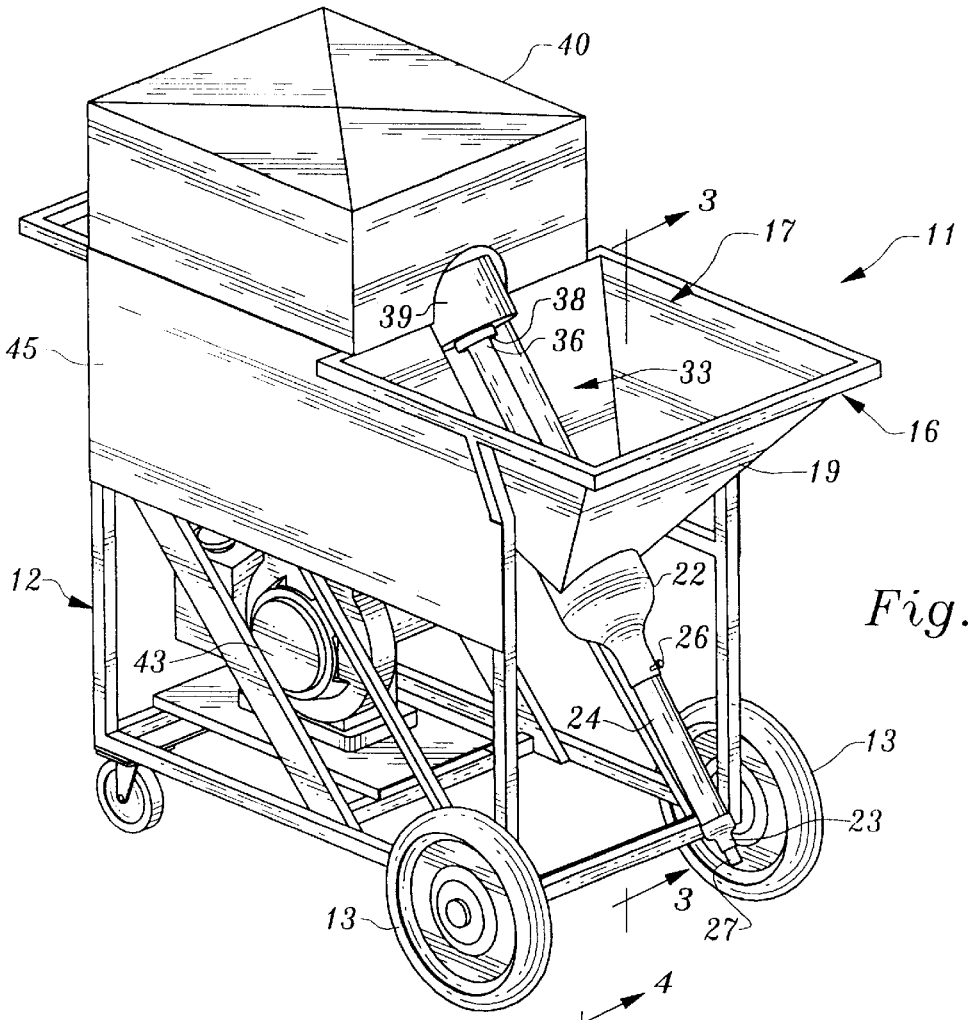
FIG. 1 is a right front perspective of the mortar pumping apparatus of the present invention.

Turning now to the drawings, and in particular to FIG. 1, the mortar pumping apparatus 11 of the present invention is shown. The apparatus includes a frame 12, having a pair of large wheels 13 at one end and a pair of pivotally mounted steering wheels 14 at the other end. A mortar containment hopper 16 is mounted on the frame 12, above wheels 13. Hopper 16 has an open, upper portion 17 and a downwardly converging, lower portion 18, as seen most clearly in FIG. 3. The hopper 16 also includes angled sidewalls 19, which direct mortar into lower portion 18.

A helical screw mortar pump 21 includes an inlet end 22, a discharge end 23, and a pump element housing 24 therebetween. Inlet end 22 is generally cylindrical in configuration, having a larger diameter upper portion and a smaller necked down portion for connection to pump element housing 24. Inlet end 22 has an opening located within lower portion 18 of hopper 16, so that mortar loaded within hopper 16 will travel by gravity directly into the inlet of the pump, The lower, necked down portion of inlet end 22 includes internal threads (not shown), for threaded engagement with an upper end of pump element housing 24. A locking bolt 26 is also provided to secure mating portions of housing 24 and inlet 22.

Discharge end 23 is thread ably secured over a lower end of pump element housing 24, and includes a connection nipple 27. Discharge end 23 is conveniently located outside hopper 16 so that an end of a mortar distribution hose 28 may be attached to nipple 27.

Figure 4A:
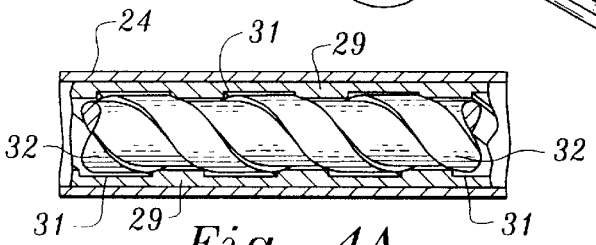
FIG. 4A is a cross-sectional view shown in an enlarged scale, taken on the arcuate line 4A—4A in FIG. 4.
Figure 6:
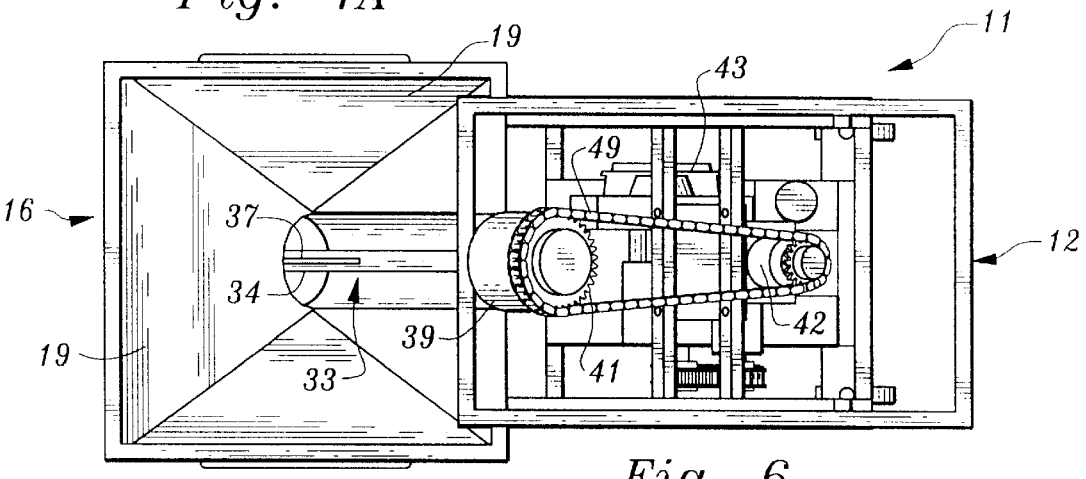
FIG. 6 is a top plan view of the pumping apparatus of the present invention, with the safety cover removed for clarity; and, FIG. 7 is a perspective view of a construction site, showing the pumping apparatus, a mortar mixer, a mortar pump line, a worker, and a mason.

Pump housing 24 is elongated, and right-circular cylindrical in configuration. Making particular reference to FIG. 4A, a resilient tubular liner 29 is provided within housing 24. Liner 29 is preferably manufactured from a dense rubber material, provided with a helical groove 31, along the entire extent of its inner wall. Liner 29 defines a right-circular cylindrical hollow within housing 24, for accommodating a helical screw pump element 32. The helical groove in liner 29 is sized and configured to accommodate the helical threads of element 32.

A pump drive shaft 33 is provided, having a lower end 34 and an upper end 36. The lower end of the drive shaft is threadably connected to an upper end of pump element 32, providing axial coincidence between shaft 33 and element 32. Opposing sides of lower end 34 are also fitted with a pair of paddles 37, extending radially from shaft 33. As will be explained more fully below, these paddles act to agitate the mortar while the pump is in operation, to prevent mortar from clogging in the hopper.

The upper end 36 of the drive shaft extends above an upper level of mortar within the containment hopper 16. The upper end 36 passes through a pair of bearings 38, secured within a cylindrical bearing housing 39 welded to frame 12. In this manner, drive shaft 33 is supported for rotation at its lower end by pump element 32, and at its upper end by bearings 38.

It should also be noted that the vertical angle, or inclination of the drive shaft, in combination with the selected length of the drive shaft, need only be sufficient to raise and maintain the upper end or the shaft out of the mortar. Based upon the teachings of the present disclosure, one of ordinary skill in the art could readily modify the angle and the length of the drive shaft to work properly in a variety of specific applications.

A drive shaft sprocket 41 is included at the upper extremity of shaft 33. A speed reduction box 42 is mounted in an intermediate portion of the frame 12, immediately above an engine 43. An electric or a hydraulic motor may be used in lieu of the internal combustion engine 43, to suit particular requirements. Reduction box 42 includes an input sprocket 44 and an output sprocket 46. An engine sprocket 47 is provided on the output shaft of a centrifugal clutch (not shown), fitted on the shaft of the engine 43. A lower chain 48 connects sprockets 44 and 47, while an upper chain 49 connects sprockets 41 and 46. The speed reduction box 42 has a gear ratio of approximately 3:1, reducing the 1800 rpm output of the engine to 600 rpm, or so. The gear ratio of box 42 may have to be changed to accommodate the speed or effective torque range of different engines or motors which may be employed A safety cover 40 is hingeably affixed along one edge to an underlying lip of hopper 16. Cover 40 prevents the operator from having injurious contact with the drive shaft sprocket 41 and the upper chain 49. Cover 40 also provides a degree of protection for the enclosed sprocket and chain, from the abrasive and corrosive effects of dry or wet mortar splatter. Performing a similar function, left and right side panels 45 are attached to the frame 12, physically isolating the chain and sprockets in the lower portion of the pumping apparatus.

Figure 7:
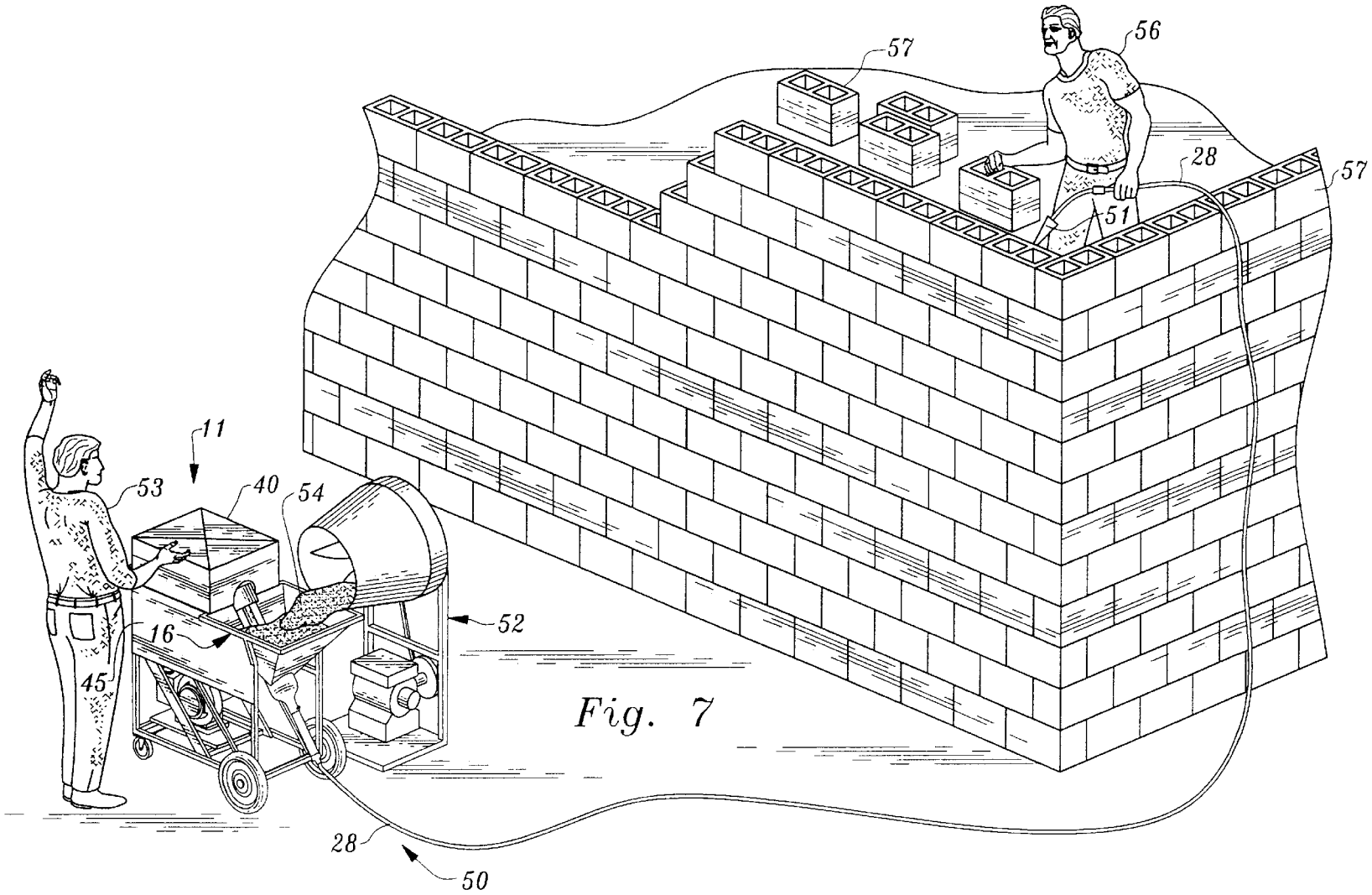

A mortar distribution hose 28, shown in FIG. 7, has a first end clamped over nipple 27. At 20 the construction site, hose 28 may be extended either horizontally or vertically, or in both dimensions, so that mortar may be delivered to a location remote from a mortar mixing and pumping site 50. At that location, a mortar discharge nozzle 51 is attached to a second end of hose 28. A mortar mixing apparatus 52, of the conventional rotary drum type, or its equivalent, is provided at the mixing site. A worker 53, also known in the masonry trade as a "hod carrier", loads dry mortar mix and water into the mixing apparatus 52. After the mortar 54 is fully mixed, the drum of the mixing apparatus is tipped, initially loading the hopper 16 with mortar.

The mortar 54 passes downwardly into the lower portion 18 of the hopper, where it fills the inlet end 22 of the mortar pump 21. The engine 43 is started, and the worker 53 increases the speed of the engine from an idle to a normal operational speed. The centrifugal clutch engages, driving sprocket 47, chain 48, sprocket 44, speed reduction box 42, sprocket 46 chain 49, and sprocket 41. Drive shaft 33, paddles 37, and pump element 32 are thereby driven to rotate in unison. Paddles 37 agitate the mortar 54, so it will stay in a substantially liquid form and not clog the hopper. Under the force of gravity, mortar is urged into the upper portion of the pump element, and thereafter positively driven by the helical screw pump element 32 through the discharge end 23. After the distribution hose 28 is entirely filled, mortar begins discharging from nozzle 51. A mason 56 directs the selective application of the mortar to the joints and grout lines for blocks or bricks 57.

As the amount of mortar within the hopper 16 becomes depleted, the worker mixes a new batch of mortar using the mixing apparatus 52. The new batch is thereafter loaded into the hopper, maintaining a continuous mortar pumping operation. The same pumping apparatus and mortar distribution system can be used in a tile setting application, in identical fashion.

In reviewing the operation of the pumping apparatus 11, it should be noted that the upper end 36 of the drive shaft 33, is always maintained in spaced relation, above the upper level of the mortar within the hopper. By reorienting the direction of the drive shaft 33, so that a middle portion of the shaft passes upwardly through the mortar, and an upper end of the shaft is maintained above the upper level of the mortar, the pump is, in effect, remotely driven by an elevated mechanism. This remote drive feature for the mortar pump provides several advantages. It eliminates the necessity and expense of a shaft seal, used in the prior art devices to pass the rotating drive shaft out through the bottom portion of the hopper. Because the seal in the prior art pump is always immersed in the abrasive mortar, it fails quickly, bringing a quick halt to the pumping operation.

Figure 2:
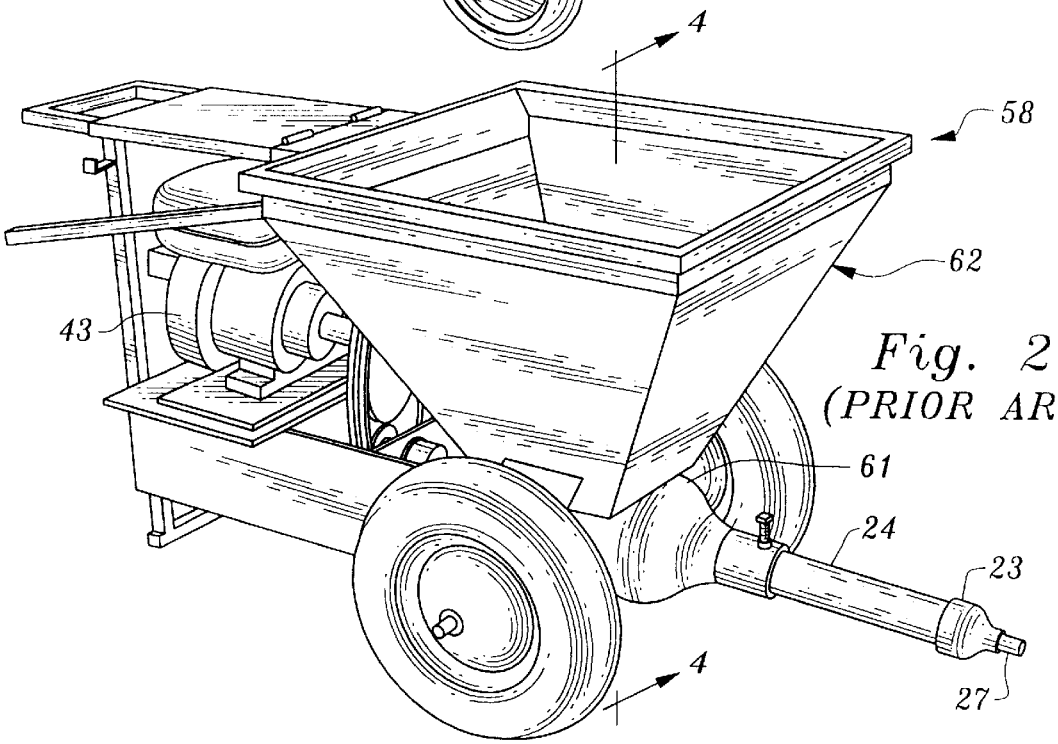
Fig. 2 (PRIOR ART)
FIG. 2 is a right front perspective of a prior art mortar pumping apparatus.
Figure 5:
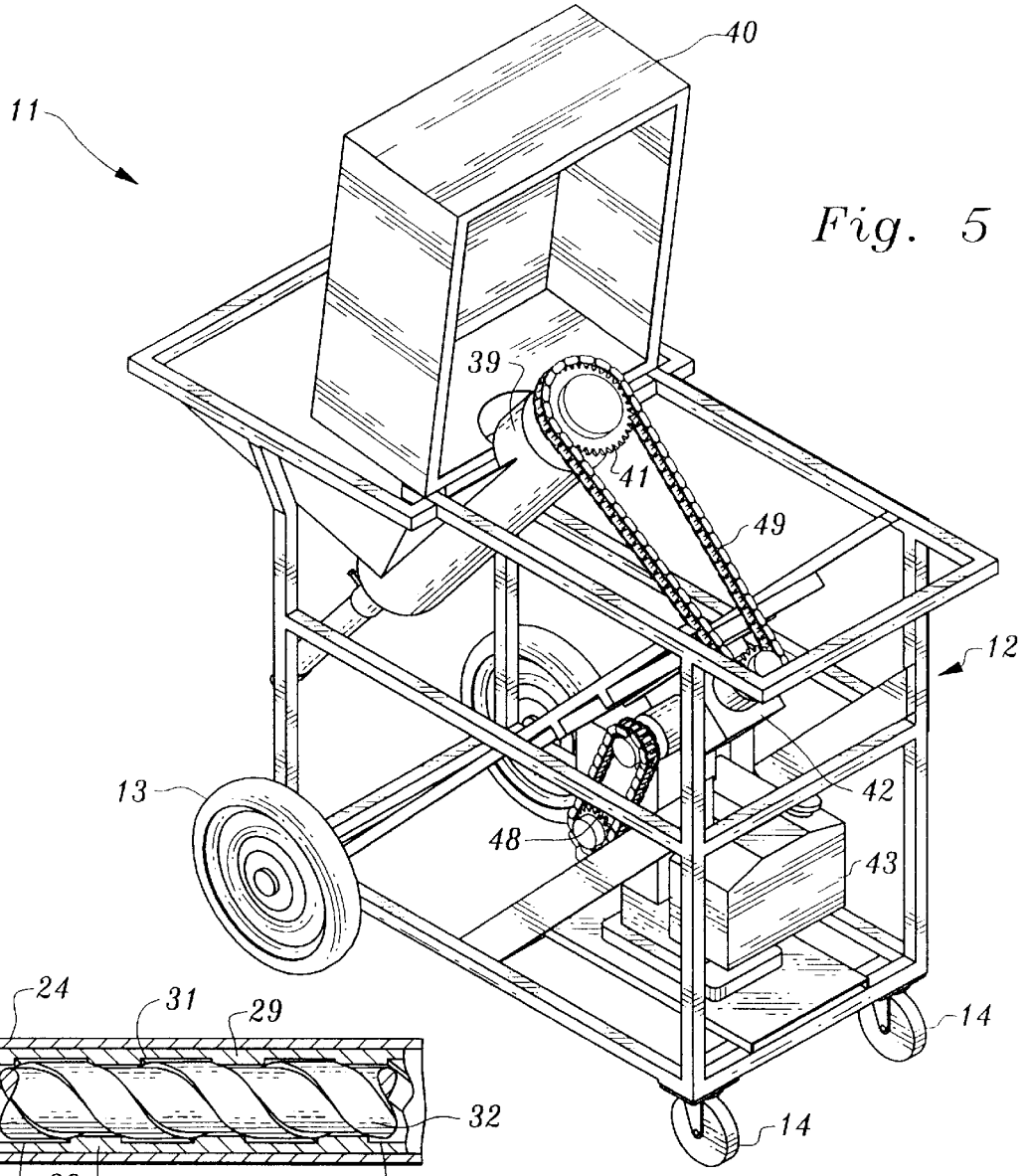
FIG. 5 is a perspective of the rear of the apparatus shown in FIG. 1, with the safety cover for the chain and drive mechanism in a raised position, and with the side cover plates removed for clarity.

Such a prior art pumping apparatus 58, is disclosed in FIGS. 2 and 4. Because apparatus 58 shares a number of apparent, common features with the apparatus 11 just describe, no attempt will be made to provide a redundant explanation herein. For example, the pump element housing 24 and all of the internal features thereof, are identical in both devices. The discharge end 23 and the nipple 27 are identical in both devices. And, the paddles 37 are identical in both devices.

The principal differences between the prior art apparatus and the present invention devolve from the orientation and structure of the drive shaft, and its associated support and drive mechanisms. The drive shaft 59 of the prior art device is elongated, and horizontally oriented. To accommodate and house the shaft 59, an elongated inlet 61 is provided. As can be seen in FIG. 4, inlet 61 is in communication with a lower portion of the hopper 62.

Drive shaft 59 passes through a seal 63 in an end wall 64 of the inlet 61, and terminates in a shaft pulley end 66. A bearing 67, bolted to a support bracket 68, maintains shaft 59 securely for rotation. A pair of lower pulleys 69, is mounted over end 66 of shaft 59. A pair of upper pulleys 71 is mounted over an output shaft of engine 43. A pair of drive belts 72 interconnects upper pulleys 71 and lower pulleys 69.

After hopper 62 is loaded with mortar 54, the operator opens the throttle of the engine until the pulleys, drive belts, and shaft are rotating at the proper operational speed. The paddles 37 agitate the mortar, and the helical screw pump element 32 drives mortar out through discharge end 23.

However, because shaft 59 is rotating within seal 63, and seal 63 has an exposed portion immersed in mortar, the small abrasive sand and cement particles of the mortar enter the seal. The constant abrasive action causes the seal to fail prematurely, in some cases in as few as 30 minutes. After the seal has failed, mortar leaks out through the seal, and begins to foul adjacent components and collect on the ground. At some point, the operator must stop the pump, remove all of the old mortar from the hopper and leaked mortar from the surrounding area, disassemble and reassemble the shaft and the seal assembly, and reload the hopper with fresh mortar. This results in a very wasteful and inefficient mortar pumping system.

It is evident from the foregoing that by eliminating the shaft seal of the prior art pumping apparatus, applicant has made a key improvement in the state of the art. It will be appreciated then that I have disclosed an improved apparatus for pumping mortar grout, providing longevity and reliability in its operation.

I claim:

1. A mortar pumping apparatus, comprising:

a. a mortar containment hopper, having an open upper portion and a lower portion;

b. a mortar pump, said pump including a housing having an inlet end and a discharge end, and a rotary pumping element therebetween, said inlet end having an opening located within said lower portion of said hopper and said discharge end extending exteriorly from said hopper;

c. a drive shaft having a lower end connected to said rotary pumping element adjacent said inlet end, a middle portion passing through said containment hopper from said lower portion to said upper portion, and an upper end adjacent said upper portion of said containment hopper and extending above an upper level of mortar within said containment hopper; and, d. drive means connected to said upper end of said drive shaft, for rotating said pumping element of said mortar pump.

2. An apparatus as in claim 1 in which said housing is an elongated tube and includes a resilient liner therein, said liner including an elongated hollow portion having inner helical grooves, and in which said rotary pumping element is a helical screw within said hollow portion.

3. An apparatus as in claim 1 in which said drive means includes an engine and speed reducing means.

4. An apparatus as in claim 1 in which said lower portion of said hopper includes downwardly converging walls, and in which said inlet is located at a lowermost convergence of said walls.

5. An apparatus as in claim 1 further including a flexible hose having a first end connected to said pump discharge end and a second end connected to a mortar discharge nozzle.

6. An apparatus as in claim 1 including a frame, said hopper and said drive means being attached to said frame.

7. An apparatus as in claim 6 in which a pair of wheels is rotatably mounted on to an underside of said frame.

8. An apparatus as in claim 1 in which said upper end of said drive shaft includes a sprocket, and in which said drive means includes a chain engaged with said sprocket.

9. An apparatus as in claim 1 in which said lower end of said drive shaft includes at least one paddle extending radially from said shaft.

10. A mortar pumping apparatus, comprising:

a. a mortar containment hopper, having an open upper portion and a lower portion, said hopper being substantially filled with wet mortar;

b. a mortar pump, said pump including a housing having an inlet end and a discharge end, and a rotary pumping element therebetween, said inlet end having an opening located within said lower portion of said hopper and said discharge end extending exteriorly from said hopper; and, c. drive means for rotating said pumping element of said mortar pump, said drive means including a drive shaft passing through said containment hopper from said lower portion to said upper portion, said drive shaft having an upper end located adjacent and above an upper level of said mortar within said containment hopper.

11. An apparatus as in claim 10 in which said housing is an elongated tube and includes a resilient liner therein, said liner including an elongated hollow portion having inner helical grooves, and in which said rotary pumping element is a helical screw within said hollow portion.

12. An apparatus as in claim 10 in which said drive means includes an engine and speed reducing means.

13. An apparatus as in claim 10 in which said lower portion of said hopper includes downwardly converging walls, and in which said inlet is located at a lowermost convergence of said walls.

14. An apparatus as in claim 10 further including a flexible hose having a first end connected to said discharge end and a second end connected to a mortar discharge nozzle.

15. An apparatus as in claim 10 including a frame, said hopper and said drive means being attached to said frame.

16. An apparatus as in claim 15 in which a pair of wheels is rotatably mounted on to an underside of said frame.

17. An apparatus as in claim 10 in which said upper end of said shaft includes a sprocket, and in which said drive means includes a chain engaged with said sprocket.

18. An apparatus as in claim 10 in which said lower end of said drive shaft includes at least one paddle extending radially from said shaft.

* * * * *